United States Patent [19]

Leonard et al.

[11] Patent Number: 4,889,332

[45] Date of Patent: Dec. 26, 1989

[54] DOCUMENT FEEDING APPARATUS

[75] Inventors: Antony J. Leonard, West Lothian; Donald A. Macleod, Renfrewshire, both of Scotland

[73] Assignee: Unisys Corporation, Blue Bell, Pa.

[21] Appl. No.: 189,922

[22] Filed: May 3, 1988

[30] Foreign Application Priority Data

Feb. 15, 1988 [GB] United Kingdom ..... 8803381

[51] Int. Cl.[4] ..... B65H 3/08

[52] U.S. Cl. ..... 271/108; 271/31.1; 271/132

[58] Field of Search ..... 271/132, 90, 99, 103, 271/107, 108, 30.1, 31.1

[56] References Cited

U.S. PATENT DOCUMENTS 1,999,836 4/1935 Guilbault ..... 271/99
3,226,108 12/1965 Bishop ..... 271/99
4,008,889 2/1977 Ayres ..... 271/99
4,050,692 9/1977 Marass ..... 271/99 X
4,569,512 2/1986 Bergerioux ..... 271/108 X

*Primary Examiner*—Richard A. Schacher
*Attorney, Agent, or Firm*—Mark T. Starr

[57] ABSTRACT

A document feeding apparatus feeds a document (18) from the endmost position (22) of a stack of documents (10) into a document path (34) using a vacuum suction head operating through an aperture (36) in a baseplate (16). A vacuum source (38) attracts a document (18) to the suction head (40) during a return stroke (50). No vacuum is applied during a forward stroke (48). The vacuum source (38) comprises a reciprocal air pump (54,108) having a potential energy store (66,90) used to power a rapid vacuum-creating return stroke despite a low-power drive source (44,96) to power the forward stroke. A barrel-pump (54) or bellows device (108) can be used as the reciprocal air pump. The vacuum-creating return stroke can be initiated either by solenoid (78) release or by operation of a cam (98) beyond a first angular position.

15 Claims, 3 Drawing Sheets

DOCUMENT FEEDING APPARATUS

BACKGROUND OF THE INVENTION

The present invention relates to apparatus for feeding documents from a stack or pile one-by-one into a document path for further processing. The present application particularly relates to, but is not restricted to, document and check sorting equipment.

In document and check sorting equipment it is known in the art to provide a stack or pile or documents as an input to a machine. Documents are drawn from the bottom of the stack or pile by a wheel assembly which is urged against a face of the document which is at the bottom of the stack or pile. The pressure of the pile against the wheel causes the document to be moved sideways from the bottom of the stack or pile to be introduced into and moved along a document processing path. The necessity that the document be moved by friction against a wheel means that considerable pressure must be applied to the stack or pile. This is not beneficial in that it raises the amount of force required to move the document from the bottom of the stack. Similarly, should the co-efficient of friction of the wheel against the lowest document prove to be less than the co-efficient of the document against the document next there-above, two documents are fed from the bottom of the stack and can cause malfunction of the document path wherein the two documents are introduced. The present invention seeks to provide a document feeding apparatus where only light pressure is exerted upon the stack sufficient to cause the stack to reach the bottom of an input hopper and wherein the feeding of individual documents is not dependent upon co-efficients of friction responding to the overall pressure of the stack.

The present invention consists of an apparatus for feeding individual documents in a first, preferred direction from the base of a plural stack of documents, said apparatus comprising; a pneumatic suction head operative to grasp a face of a document at the base of the stack when air is induced to enter therein; motive means, coupled to move said head in a first stroke in a second direction opposite to said first direction, and thereafter in a second stroke in said first direction; and a pneumatic vacuum source operative to induce passage of air into said suction head during said second stroke.

Pneumatic vacuum sources as known in the prior art are bulky and expensive and require repeated maintenance. The present invention in its preferred embodiments seeks to improve over prior art vacuum sources by providing that the vacuum source comprises a reciprocal air pump coupled to the motive means to operative in synchronism with movement of the suction head.

Provision of sufficient instant energy to create a standing vacuum through a suction head of any great value necessitates the provision of large instantaneous power. It is known in the art to provide such power by means of large motors. The preferred embodiment of the present invention seeks improvement over the prior art in this respect by arranging that the motive means comprises an elastic potential energy store operative to store potential energy during the first stroke and to release that potential energy during the second or return stroke. The preferred embodiment of the present invention also provides that the first stroke is achieved using less power than the second stroke. In this manner a low power motor can be used to store potential energy which is suddenly released in a high-power burst on the second stroke.

In order that the second stroke may be initiated the embodiment of the present invention provides a retention means for retaining the motive means at the termination of the first stroke which is then selectively operable to initiate the second stroke. In one preferred embodiment the release means is a solenoid engaging a recess on a shaft, the solenoid being selectively operable. In another preferred embodiment the release means is a cam and cam follower on a motor where rotation of the motor beyond a first angular position (where it is retained at the end of the first stroke) causes the cam follower to have virtual freedom of movement for the return or second stroke.

While it is known in the art to provide air pumps in the form of fans or blowers, the embodiments of the present invention seeks simplification over the prior art by providing in one embodiment that the reciprocal air pump is an ordinary barrel air pump and in another embodiment that the reciprocal air pump is a bellows. In each instance, in order that a document shall be released into the document path, the embodiments provide that a release valve is engaged at termination of the second stroke to release any residual vacuum in the reciprocal air pump. In an alternative embodiment it is arranged that the air pump is leaky so that the vacuum is self-releasing after the suction head has moved sufficiently far to cause the document to be introduced into a subsequent document track.

In the embodiments of the present invention it is provided in one instance that the energy store comprises a spring, and in another instance that the energy store comprises a mass of air which may either by compressed or rarefied as a result of the first stroke and whose stored potential energy is converted into kinetic energy on the second stroke.

DESCRIPTION OF THE DRAWINGS

The present invention is further explained with reference to the following description in conjunction with the appended drawings in which.

DESCRIPTION OF THE DRAWINGS

Figure 1:
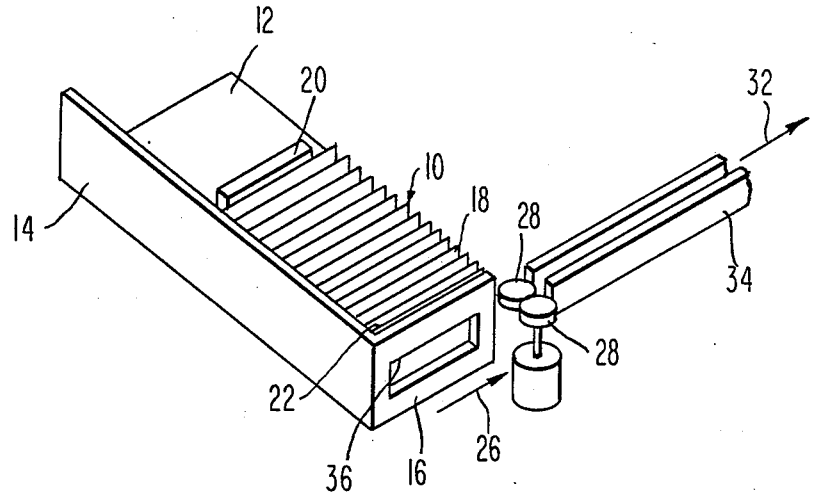
FIG. 1 shows a projected view of a document hopper suitable for use with the present invention.

FIG. 1 shows a projected view of a document hopper suitable for use with the present invention. A stack of documents 10 rests on a baseplate 12 aligned with a side retaining wall 14. The baseplate 12 can be horizontal or can have a small tilt with reference to the horizontal plane. If the baseplate 12 is tilted relative to the horizontal plane the stack of documents 10 can rest against an endplate 16 under the collective weight of the individual documents 18 or can be urged by a light shoe 20 resting on the top of the stack 10 of documents 18. If the baseplate 12 is horizontal the shoe 20 can be urged against the stack 10 of documents 18 by using a light spring, not shown. The pressure experienced by the stack 10 of documents 18 is very low and would be insufficient to allow reliable feeding of documents 18 from the bottom position 22 of the stack 10 according to methods used in the prior art. Documents 18 are fed from the bottom 22 of the stack 10 as indicated by a first arrow 26 one-by-one from behind the endplate 16 (as shown in FIG. 1) between a pair of opposed pinch wheels 28 driven by a pinch wheel motor to be introduced in a direction indicated by a second arrow 32 into a document track 34. The endplate 16 has a transfer slot 36 which, as will hereinafter be shown, permits introduction of a pneumatic suction head.

Figure 2:
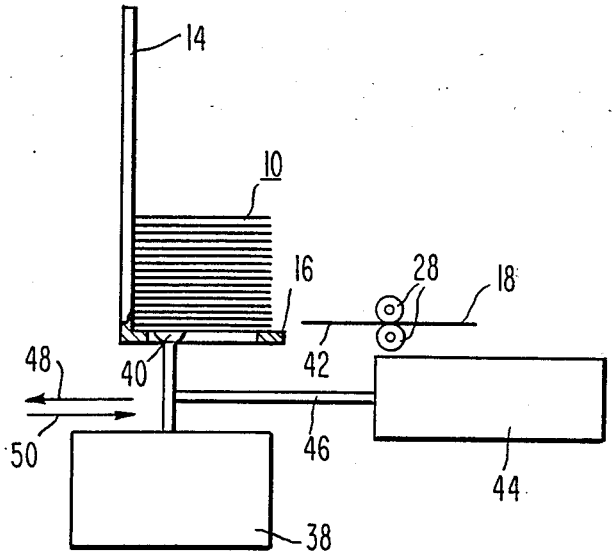
FIG. 2 shows a schematic diagram of the document hopper of FIG. 1 and includes a vacuum source and motive means.

FIG. 2 shows a schematic diagram of those items shown in FIG. 1 together with further items comprising the present invention.

A vacuum source 38 is coupled to a pneumatic suction head 40 which can move in the transverse slot 36 shown in FIG. 1. The suction head 40 grips the lower face 42 of the document 18 when the vacuum source 38 causes induction of air through the suction head 40. Motive means 44 move the suction head 40 by means of mechanical coupling 46 in a cycle comprising a first stroke as indicated by a third arrow 48 and a second stroke as indicated by a fourth arrow 50. During the first stroke 48 the vacuum source 38 does not cause induction of air through the suction head 40. During the second stroke 50 the vacuum source 38 causes induction of air through the suction head 40. This causes the suction head 40 to attract the lower face 42 of a document 18 there-against and the document 18 is moved from its position on the bottom of the stack 10 between the opposed pinch wheels 28 to be introduced into the document track 34. At the end of the second stroke 50 induction of air through the suction head 40 ceases, the suction head 40 releases the lower face 42 of the document 18, and the pinch wheels 28 take over control of movement of the document 18. The degree of vacuum is sufficient to cause the document 18 to move with the suction head 40 as the suction head moves as indicated by the fourth arrow 50 during the second or return stroke.

Figure 3:
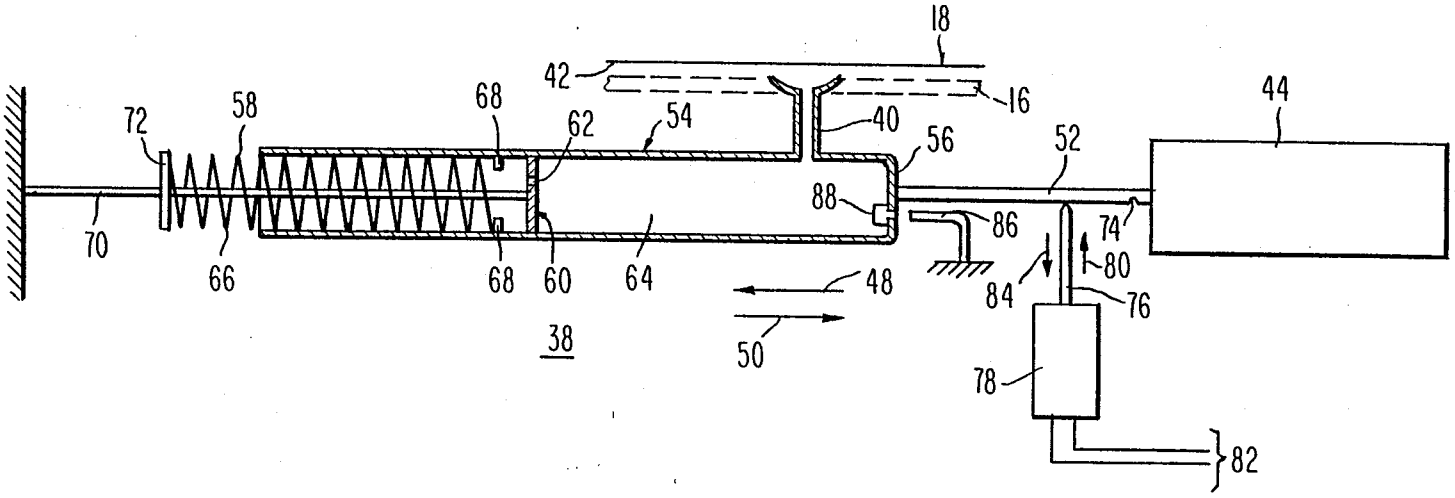
FIG. 3 shows a schematic representation of a vaccum source according to a first preferred embodiment and incorporates a first preferred form of retention means.

FIG. 3 shows one form of the preferred embodiment of the vacuum source 38. A reciprocal air pump is provided in the form of a barrel pump. The motive means 44 drives a shaft 52 to move a pump body 54 in the general form of a cylindrical shell closed at a first end 56 and open at a second end 58. A piston 60 provides a pneumatic seal within the pump body 54 and is provided with a first one-way valve 62 which allows air to exit from the main chamber 64 of the pump but which closes to retain a vacuum in the main chamber 64.

A potential energy store is provided in the form of a compression spring 66 engaging lips 68 within the pump body 54 and on the other side of the piston 60 from the main chamber 64. The piston 60 is maintained on a fixed shaft 70 having a flange 72 for engaging the other end of the compression spring 66. As the motive means 44 moves the shaft 52 as indicated by the third arrow 48 so the pump body 54 moves with the shaft 52 compressing the compression spring 66. Air is expelled from the main chamber in this the first stroke of the cycle. When a notch 74 on the shaft 52 engages the armature 76 of a solenoid 78, the armature 76 moves under spring pressure as indicated by a fifth arrow 80 to engage the notch 74 and retain the shaft 52 at the termination of the first stroke. When the solenoid 78 is operated by means of an electrical signal provided on wires 82 the armature 76 is withdrawn from the notch 74 as indicated by the sixth arrow 84 to release the shaft 52 which in turn releases the pump body 54. The energy stored in the compression spring 66 is then rapidly released to create a vacuum in the main chamber 64 which is sustained by the closure of the first one-way valve 62. Air rushes in through the suction head 40 and attacts the lower face 42 of the document 18 against the suction head 40. The document 18, held on the suction head 40, moves with the suction head 40 as the second stroke is executed as indicated by the fourth arrow 50. When the pump body 54 approaches the righthand extremity of the second or return stroke a fixed arm 86 engages a releasable valve 88 allowing ingress of air into the main chamber 64 so that the vacuum therein is released and the document 18 allowed to progress into the document track 34.

Figure 4:
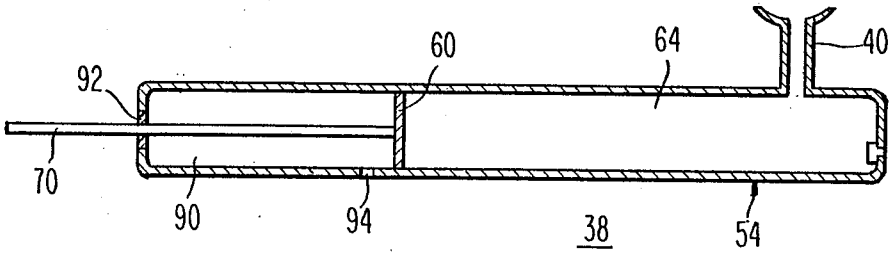
FIG. 4 shows an alternative form of the vacuum source of FIG. 3.

FIG. 4 shows an alternative form of the vacuum source of FIG. 3. The compression spring 66 is omitted and instead a secondary chamber 90 is provided by allowing the fixed shaft 70 to enter the pump body (54) via a pneumatic seal 92. The first one-way valve 62 is omitted from the piston 60 and, as the first stroke is executed so a vacuum builds up in the secondary chamber 90. Compressed air in the main chamber 64 is merely allowed to escape through the suction head 40. This escape of air through the suction head 40 has no effect since it merely serves slightly to repel the lower face 42 of the document 18. During the second stroke external air pressure causes the pump body to move as indicated by the fourth arrow 50 by virtue of the vacuum in the secondary chamber 90.

Within the embodiments of the present invention as hereinbefore and hereinafter described, it is also provided that the potential energy source shown respectively as a compression spring 66 and as a secondary vacuum chamber 90 can also comprise springs which are extended and secondary chambers 90, either integral with the pump body or not, wherein air is compressed.

It is also provided in the present invention as hereinbefore and hereinafter described in its various embodiments that the releasable valve 88 and the fixed arm 86 can be dispensed with by providing that the main chamber 64 is leaky. That is to say, as well as an ingress of air through the suction head 40 ingress of air is allowed through other apertures. The sizes of the other apertures are such that the vacuum in the main chamber 64 has substantially dissipated itself by the time the pump body 54 has reached the extremity of the second stroke.

In another form of vacuum release applicable to those embodiments of the present invention hereinbefore described, the releasable valve 88 and fixed arm 86 are replaced by a breathing hole 94 which is uncovered by the piston 60 at or near the extremity of the second stroke to allow ingress of air into the main chamber 64.

Figure 5:
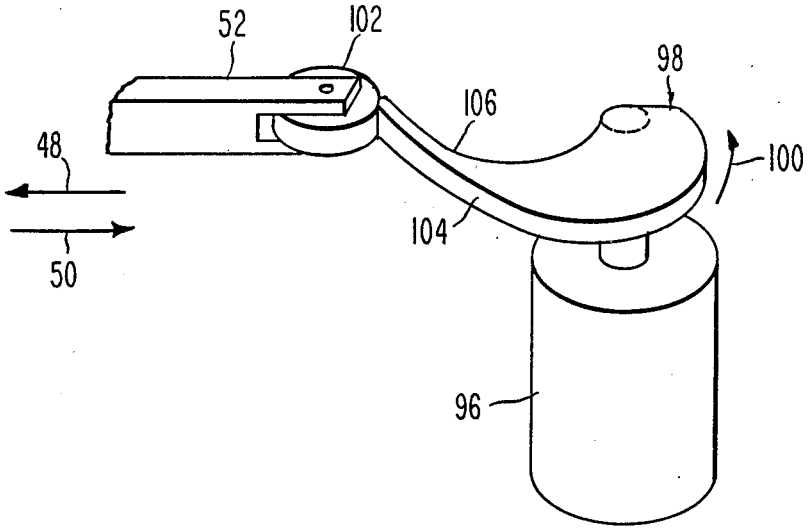
FIG. 5 shows another embodiment of the motive means of FIG. 3 wherein retention and release is achieved by a cam and cam follower.

FIG. 5 shows an embodiment of the motive means 44 and an alternative release means in place of the solenoid 78 and armature 76.

An electric motor 96 rotates a cam 98 as indicated by a seventh arrow 100. The rotation of the cam 98 by the motor 96 may be achieved directly or by means of a gearbox. Use of a gearbox is preferred in that it allows the electric motor 96 to be a low power device whose torque is increased by the gearbox. A cam follower 102 is attached to the end of the shaft 52. The cam 98 is provided with a first, spiral face 104. The cam 98 is also provided with a second sheer face 106. The motor 96 is angularly controlled. During the first stroke as indicated by the third arrow 48 the cam follower 102 engages the spiral face 104 of the cam 98 from that portion of the spiral face 104 which is of least radius until the position is achieved which is shown in FIG. 5 where the cam follower 102 is at an extremity of the first stroke. The motor 96 is then stopped. When it is desired to execute the second stroke the motor 96 is simply incrementally rotated as indicated by the seventh arrow 100 and the cam follower 102 seeks to engage the sheer face 106 of the cam 98. This movement is very rapid since the sheer face 106 is provided as a re-entrant function of the cam 98 angle. In this way the second stroke as indicated by the fourth arrow 50 is rapidly achieved.

Figure 6:
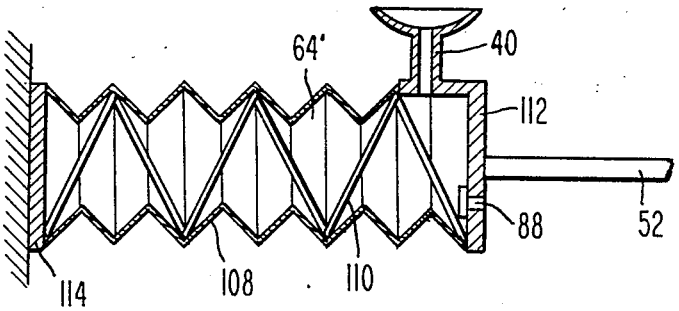
FIG. 6 shows yet another form of vacuum source by way of bellows.

FIG. 6 shows a replacement for the barrel pump hereinbefore provided as the vacuum source 38 in the present invention. A substantially cylindrical bellows skin 108 capable of concertina expansion and contraction is provided around an internal support and compression spring 110 between a mov able face member 112 and a fixed backplate member 114. The pneumatic suction head 40 is provided on the movable face member 112 which in turn is moved by the shaft 52. The bellows skin 108 can be made semi air-permeable so that the vacuum in the main chamber 64' is self-releasing when the second stroke is completed. Alternatively the releasable valve 88 can be provided for use as indicated in the description for FIG. 3. Likewise, the equivalent of the first oneway valve 62 can be provided in the movable face member 112 to allow air to exit from the main chamber 64' during the first stroke. Just as with the other embodiments, the first one-way valve 62 can be completely omitted allowing exit of the air through the suction head 40 during the first stroke. As before, this merely has the effect of repelling the face 42 of the document 18.

The present invention also comprises the various features of the embodiments herebefore described taken singly or in combination.

What is claimed is:

1. An apparatus for feeding individual documents in a first direction from the base of a stack of documents comprising:

pneumatic vacuum means including a movable body member having opposed extremities, said body member being closed at least at one extremity, a fixed piston disposed within said body member, such that a main chamber is formed between said body member and said piston, a pneumatic suction head affixed to said body member and operative to grasp a face of a document at the base of the stack when air is induced to enter therein;

a first motive means, coupled to move said body member and said head in a first stroke in a second direction opposite to said first direction, said movement of said body member in said second direction causing the expulsion of air from said main chamber;

and a second motive means independent of said first motive means, said second motive means being coupled to move said body member and said head thereafter in a second stroke in said first direction, said movement of said body member in said first direction causing the induction of air through said suction head into said main chamber.

2. An apparatus according to claim 1 wherein said pneumatic vacuum means comprises a reciprocal air pump

3. An apparatus according to claim claim 2 wherein said second motive means comprises an elastic potential energy store operative to store potential energy during said first stroke and to release energy to power said second stroke.

4. An apparatus according to claim 3 wherein said first motive means further comprises a motor operative to provide energy for said first stroke, and retention means operative to retain said first motive means at the termination of said first stroke and selectably releasable to initiate said second stroke.

5. An apparatus according to claim 4 wherein said motor is operative to rotate a cam; said motor moving said cam to a first angular position at the completion of said first stroke, said retention means comprising a cam follower engaging said cam, and said motor rotating said cam beyond said first angular position to release said cam follower to initiate said second stroke.

6. An apparatus according to claim 2 wherein said reciprocal air pump comprises a barrel air pump.

7. An apparatus according to claim 2 wherein said reciprocal air pump comprises a bellows.

8. An apparatus according to claim 3, wherein said energy store comprises a spring.

9. An apparatus according to claim 3 wherein said energy store comprises a mass of air.

10. An apparatus according to claim 1 including document release means operative to cause cessation of induction of air through said suction head at the termination of said second stroke.

11. An apparatus according to claim 10 wherein said document release means comprises a valve, automatically operated at the termination of said second stroke of release the vacuum in said pneumatic vacuum means.

12. An apparatus according to claim 1 wherein the rate of power applied by said first motive means in said first stroke is less than the rate of power applied by said second motive means in said second stroke.

13. An apparatus according to claim 1 further characterized in that said body member of said pneumatic vacuum means is open at its opposite extremity, said fixed piston being attached to a stationary shaft entering said open extremity of said body member.

14. An apparatus according to claim 13 wherein said second motive force is a compression spring having opposite extremities, said spring encircling said shaft and being at least partially disposed within said body member, said body member having lip-like projections for engaging one extremity of said spring, and said shaft having a flange for engaging the opposite extremity of said spring.

15. An apparatus according to claim 14 wherein said fixed piston includes a one-way valve for permitting said expulsion of air from said main chamber during said first stroke, and preventing said expulsion of air during said second stroke.

* * * * *